US007008073B2

(12) United States Patent
Stuhlmacher, II

(10) Patent No.: US 7,008,073 B2
(45) Date of Patent: Mar. 7, 2006

(54) PLUMBING AND LIGHTING FIXTURE

(76) Inventor: Glen Stuhlmacher, II, 45 Cuenca Ct., San Ramon, CA (US) 94583

( * ) Notice: Subject to any disclaimer, the term of this patent is extended or adjusted under 35 U.S.C. 154(b) by 59 days.

(21) Appl. No.: 10/745,142

(22) Filed: Dec. 22, 2003

(65) Prior Publication Data

US 2005/0135099 A1 Jun. 23, 2005

(51) Int. Cl.
*F21V 33/00* (2006.01)

(52) U.S. Cl. ..... 362/96; 362/101; 362/253; 362/800

(58) Field of Classification Search ..... 362/96, 362/101, 253, 800; 239/18
See application file for complete search history.

(56) References Cited

U.S. PATENT DOCUMENTS 4,749,126 A * 6/1988 Kessener et al. ..... 239/12
6,126,290 A 10/2000 Veigel ..... 362/96
6,637,676 B1 * 10/2003 Zieger et al. ..... 239/548
6,805,458 B1 * 10/2004 Schindler et al. ..... 362/96
2004/0179351 A1 * 9/2004 Patterson ..... 362/96

* cited by examiner

*Primary Examiner*—Ali Alavi
(74) *Attorney, Agent, or Firm*—Silicon Edge Law Group, LLP; Mark A. Lauer

(57) ABSTRACT

A plumbing fixture mounted to a sink or other basin has a base region that also serves as a source of visible light, providing a pleasing aesthetic effect. Separate bases for faucet handles and a faucet spout can be illuminated individually or as a group. A faucet spout, trim and/or handle can be made of translucent or transparent material (e.g., acrylic, plastic, glass, crystal, etc.) that captures and redirects light from the base, and may have opaque areas that provide other interesting patterns. The faucet light or lights can also serve as a nightlight for a bathroom or kitchen, saving the space that a separate nightlight would require. In another embodiment a light is provided in a faucet spout, which can illuminate a sink for a pleasing effect, and can also serve as a nightlight. The spout can be translucent, carrying light as well as water from its base.

33 Claims, 4 Drawing Sheets

PLUMBING AND LIGHTING FIXTURE

TECHNICAL FIELD

The present application relates to lighting and plumbing fixtures, such as faucets and lamps.

BACKGROUND

Nightlights are sometimes used in bedrooms or bathrooms to faintly illuminate the rooms at night. Often such lights are not built into a house, however, because of the limited space for light fixtures, and are instead provided by plugging a lamp into a power outlet.

The beauty of light playing with water is well known, as are lighted fountains and showers. Toward this end, U.S. Pat. No. 6,126,290 to Veigel discloses a water draining fixture having a centrally disposed light distributor that is surrounded by water jets, so that the light shines through the water for a pleasing effect. Veigel states that an advantage of this configuration is that a light distributor can be removed and cleaned of calcium deposits, as opposed to a prior patent (WO 95/29300) that veigel states has light fed through a transparent window into the water flowing through the fixture head.

While these patents offer fixtures that illuminate flowing water, neither is optimized for providing lighting or decoration whether the water is flowing or not.

SUMMARY

In one embodiment a plumbing fixture for supplying water to a basin is disclosed that has a spout containing a water conduit, and a handle connected to a valve to control water flow through the water conduit, wherein at least one of the handle and the spout has a base region to hold the fixture adjacent to the basin, the base region containing a lamp, the lamp emitting visible light. For example, the plumbing fixture may be a faucet that is attached to a sink or countertop at a base that also serves as a source of visible light, providing a pleasing aesthetic effect. Separate bases for faucet handles and a faucet spout can be illuminated individually or as a group. A faucet spout and/or handle trim can be made of translucent or transparent material (e.g., acrylic, glass, crystal, etc.) that captures and redirects light from the base. The faucet light or lights can also serve as a nightlight for a bathroom, kitchen, laundry or bar, saving the space that a separate nightlight would require. In another embodiment a light is provided in a faucet spout, which can illuminate a sink for a pleasing effect, and can also serve as a nightlight. The spout can be translucent, carrying light as well as water from its base.

DETAILED DESCRIPTION OF THE PREFERRED EMBODIMENT

Figure 1:
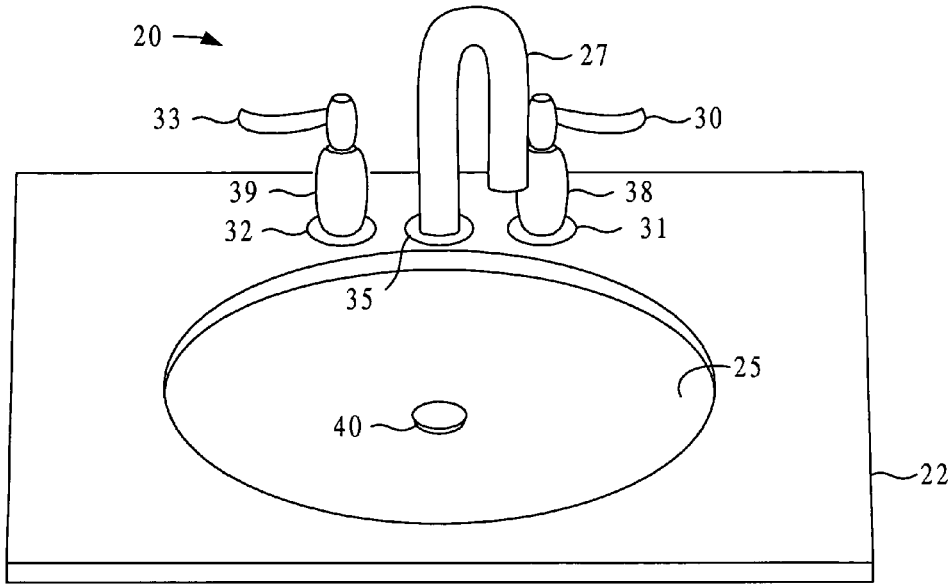
FIG. 1 is a perspective view of a sink with a faucet spout and handles attached at a base that includes a lamp.

FIG. 1 shows a plumbing fixture such as a faucet 20 for supplying water to a basin such as a sink 25, the faucet attached to a countertop 22 and the sink. The faucet includes a spout 27, a right handle 30 and a left handle 33. The spout 27 has a base 35 that is attached to the countertop 22, and the handles 30 and 33 each have a base 31 and 32 that are attached to the countertop. The handles 30 and 33 also each have a shroud or body 38 and 39 that is disposed adjacent to the respective bases 31 and 32. A stop 40 is positioned at the bottom of the sink 25 to control water flow out of the sink. Although difficult to represent in this drawing, bases 31, 32 and 35 are each illuminated, providing a pleasing aesthetic effect.

Figure 2:
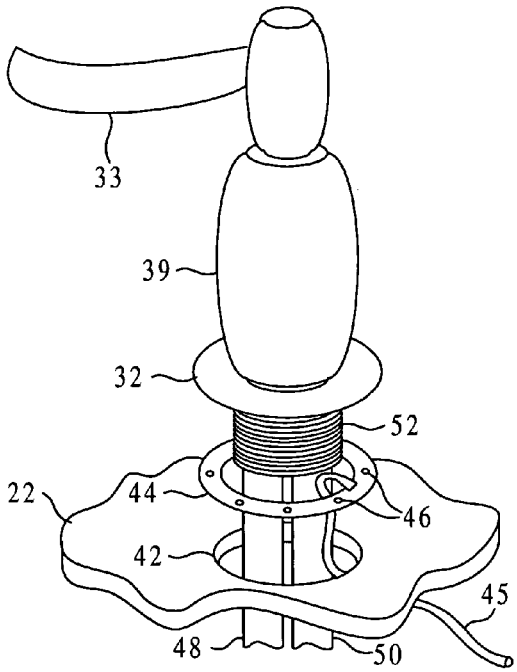
FIG. 2 is an exploded perspective view of one of the handles of FIG. 1.

FIG. 2 is an exploded view of the left handle 33 as it is being attached to the countertop 22 or sink 25 through an aperture 42. The handle is 33 may be shaped in many different styles, only one of which is shown. A light source such as a lamp 44 includes a plurality of light-emitting diodes (LEDs) 46 that are affixed to an annular substrate such as a circuit board. A lead wire 45 provides electricity for the LEDs 46 through a plurality of wires that are attached to the substrate 44. The base 32 in this embodiment is made of a translucent material such as acrylic, plastic, glass, crystal, etc., and may act as a lamp shade, lens or surface. As with other embodiments, the translucent material may be transparent, frosted, colored, patterned, etc. Also, the base may have opaque as well as translucent areas, and may be perforated, filigreed, laser etched or otherwise patterned.

A hot water inlet conduit 48 and a hot water outlet conduit 50 protrude through the lamp 44 and aperture 42, with fluid communication between the conduits 48 and 50 controlled by a valve that is connected to the handle 33 within the body 39, as is conventional. A threaded fitting 52 provides an attachment for a nut, not shown, to clamp the body 39 to the countertop 22, thereby fastening the plumbing fixture 20 to the sink area. The base 32 may be pressed directly against the countertop with sealant such as silicone rubber in this embodiment, although a waterproof gasket may also be interposed between the base 32 and the countertop or the substrate may also serve as such a gasket. Instead of mounting on a countertop or sink, the fixture can be mounted on a basin, tub, shower, etc.

Figure 3:
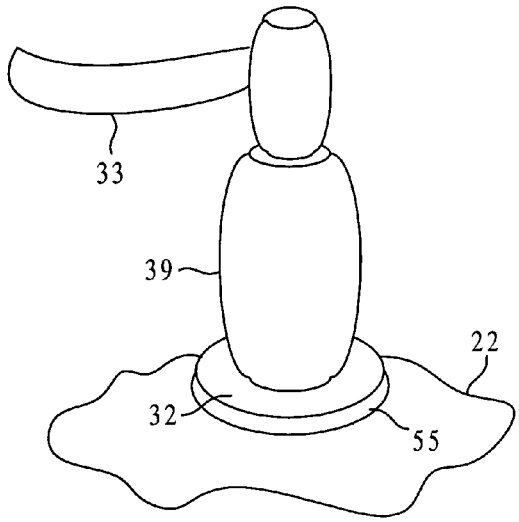
FIG. 3 is a perspective view of a faucet handle having a metal ring disposed at the base, with light emitted from an upper surface of a lamp.

In FIG. 3 a metal ring 55 is clamped between the translucent ring 32 and the countertop 22, with the light emitting from an upper surface of the translucent ring 32. Instead of the ring 55 being made of metal, the ring 55 may be made of other materials such glass, acrylic, plastic, etc.

Figure 4:
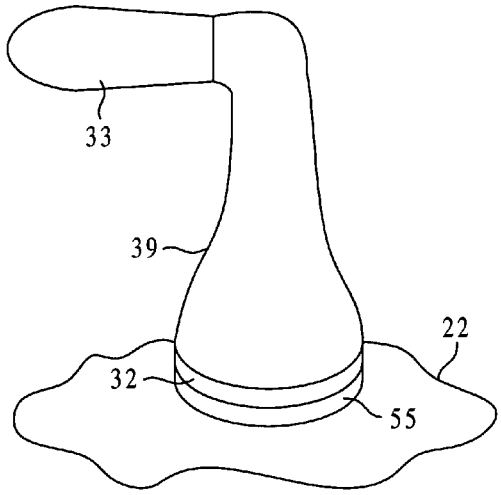
FIG. 4 is a perspective view of a faucet handle having a metal ring disposed at the base, with light emitted from an outer surface of a lamp.

FIG. 4 shows an example in which the metal ring 55 is clamped between the translucent ring 32 and the countertop 22, with light emitting from a side surface of the translucent ring 32. Instead of the ring 55 being made of metal, the ring 55 may be made of other materials such glass, acrylic, plastic, etc.

Figure 5:
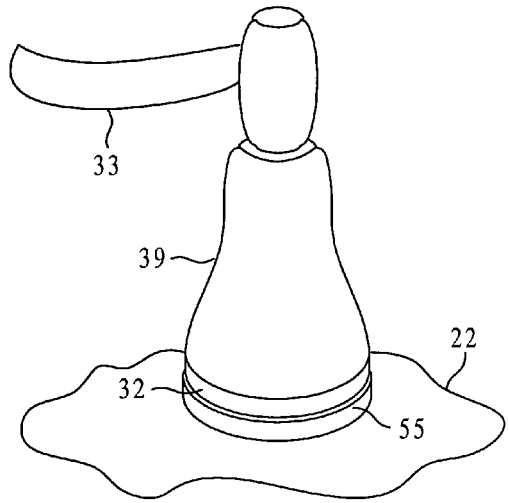
FIG. 5 is a perspective view of a faucet handle having a metal ring disposed at the base, with light emitted from an outer surface of a lamp that fits within the ring.

In FIG. 5 the translucent ring 32 fits within and protrudes above the metal ring 55. The metal ring 55 is clamped between the translucent ring 32 and the countertop 22, with the light emitting from a side surface of the translucent ring 32. Instead of the ring 55 being made of metal, the ring 55 may be made of other materials such glass, acrylic, plastic, etc.

Although depicted in FIG. 1–FIG. 5 as having a smooth surface to facilitate illustration, the translucent ring 32 can have an etched, grooved, corrugated or otherwise uneven surface that refracts light in various patterns. Such an uneven surface can also be formed on an inner surface of the translucent ring 32, for example as a pattern of V-shaped grooves. Such grooves can act as a prism that separates white light into different colors. Also possible is a translucent ring that has metal strips, flakes or other patterns spaced about its periphery.

Figure 6:
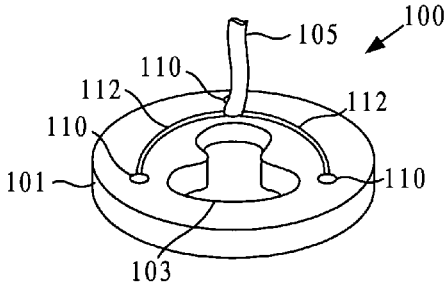
FIG. 6 is a perspective view of a lamp that fits near a base of a faucet spout, the lamp including a plurality of light sources embedded in a translucent block.

FIG. 6 shows a lamp 100 including a translucent substrate 101 that includes at least one light source embedded in the substrate, the substrate 101 designed to fit near a base for a faucet spout. The lamp 100 is turned upside-down from its normal operating orientation to display the integration of the light source into the substrate 101. The substrate 101 is generally ring-shaped and has a pear-shaped aperture 103 near its center to allow a water conduit and rod for a sink stop to pass through, neither of which is shown in this figure. Other shapes for the substrate 101 and aperture are alternatively possible. An insulated electrical lead 105, a cutaway portion of which is shown, connects the light source with a power source, not shown. A plurality of LEDs 110 are disposed in holes in the substrate 101 and are connected to the lead 105 with wires fitting in grooves 112 in the substrate. Light is emitted from the lamp 100 along outer and bottom surfaces of the substrate 101 (in operation from outer and upper surfaces), depending upon which of those surfaces are exposed.

The LEDs 110 may be white or colored, and typically the electricity supplied by the lead 105 is both low voltage and low current, for low power consumption and low risk of shock. For example, the lead 105 may provide direct current of 0.05 to 0.15 amperes at a voltage of between about 2 and 5 volts. A transformer may be provided, not shown, that converts alternating household current of 120 volts to that needed for the LEDs 110. The transformer may be connected to a ground fault circuit interrupter (GFCI) outlet to further reduce risks.

Figure 7:
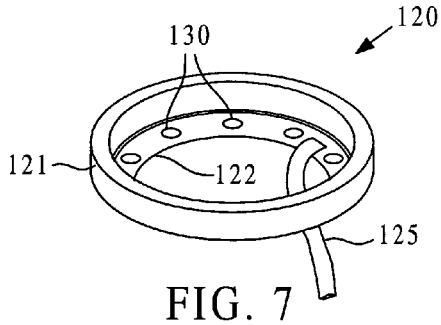
FIG. 7 is a perspective view of a lamp including a plurality of light sources attached to a substrate encircled by a translucent block.

In FIG. 7 a lamp 120 is shown including a translucent ring 121 that surrounds a substrate 122 holding at least one light source, the ring and substrate fitting near a base for a faucet spout or handle. The substrate 122 has an aperture to allow a water conduit and rod for a sink stop to pass through, or to allow a pair of water conduits to pass through. An insulated electrical lead 125, a cutaway portion of which is shown, connects the light source with a power source, not shown. A plurality of LEDs 130 are affixed to the substrate 122 and are connected to the lead 125 with wires attached to the substrate. Light is emitted from the lamp 120 along outer and upper surfaces of the ring 121, depending upon which of those surfaces are exposed. For example, FIG. 5 illustrates a situation in which primarily the outer surface of translucent ring 32 emits light.

Figure 8:
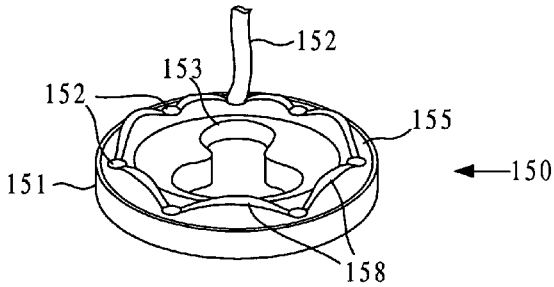
FIG. 8 is a perspective view of a lamp including a plurality of light sources attached to a substrate that fits beneath a translucent block near a base of a faucet spout.

FIG. 8 shows a faucet lamp 150 in which a translucent block 151 is disposed adjacent a substrate 155 holding a plurality of light sources 152, the block and substrate designed to fit near a base for a faucet spout or handle. The lamp 150 is turned upside-down from its normal operating orientation to display the light sources 152 and substrate 155 that shine light up through the block during operation. The block 151 has a pear-shaped aperture 153 near its center to allow a water conduit and rod for a sink stop to pass through, neither of which is shown in this figure. An insulated electrical lead 152, a cutaway portion of which is shown, and a plurality of wires 158 connect the light sources 152 with a power source, not shown. The light sources 152 may be LEDs, the base of which is shown, with the wires depicted in exaggerated fashion to facilitate illustration. Light is emitted from the lamp 150 along outer and upper surfaces of the block 151, depending upon which of those surfaces are exposed. For example, FIG. 2 illustrates a situation in which primarily the upper surface of translucent ring 32 emits light that is visible outside the faucet. Note also that each of the embodiments discussed so far is generally removed from contact with water so that calcium deposits or other water stains are not a problem.

Figure 9:
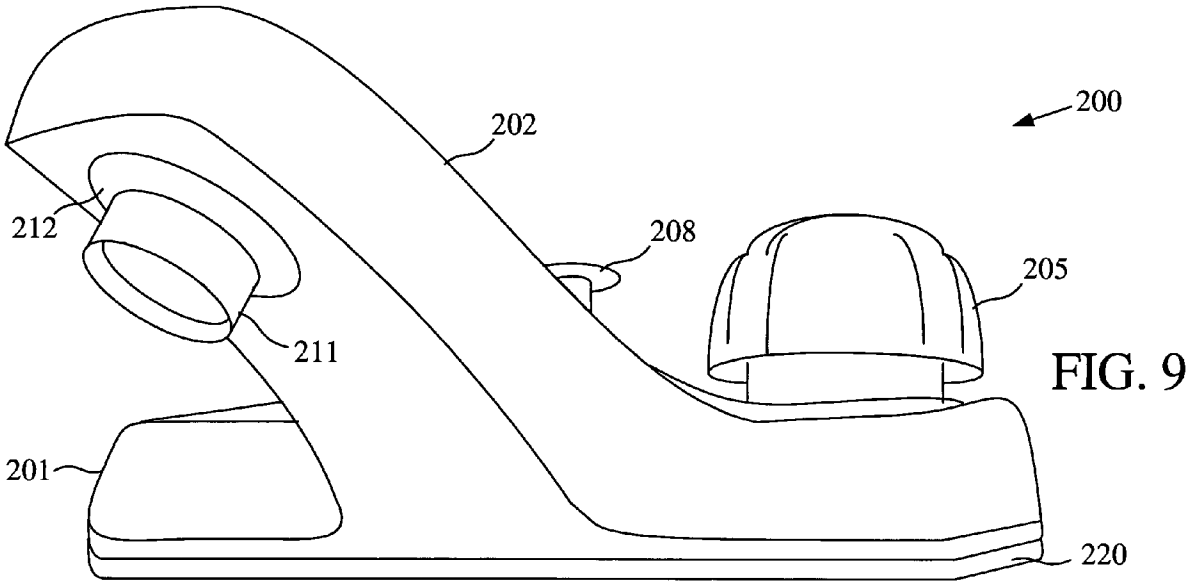
FIG. 9 is a perspective view of a faucet having a substantially unitary body with a lamp disposed near an aerator of a spout.

FIG. 9 shows a faucet 200 having a substantially unitary body 201 that includes a spout as well as handles 205, one of which is hidden from view. A lift rod 208 for a sink stop is also partly hidden from view by the spout 202. An aerator 211 is attached to the spout 202 with a light-emitting block 212 fitted around the aerator and within the spout 202. A base 220 for the faucet 200 may also act as a lamp, much as described before.

Figure 11:
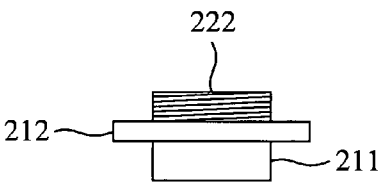
FIG. 11 is a cross-sectional view of the lamp and aerator of FIG. 10.
Figure 10:
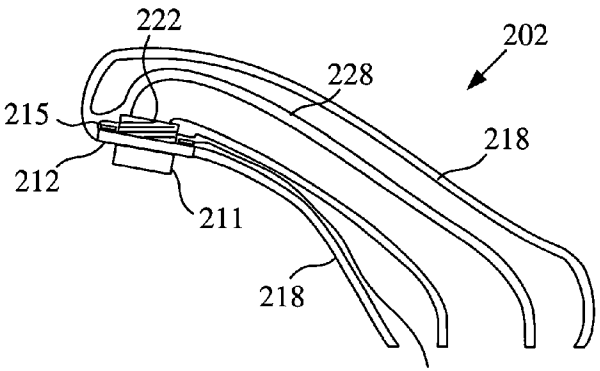
FIG. 10 is a cross-sectional view of the spout of FIG. 9 with the lamp and aerator attached.

As shown in FIG. 10, block 212 is a translucent ring that is seated atop light source 215. Referring also to FIG. 11, translucent ring 212 is attached to the aerator 211, which has a threaded portion 215 for attachment to spout 202. The spout 202 is formed of an exterior wall 218, and has a water conduit 228 into which the threaded portion 215 is screwed. Alternatively, the block 212 may be affixed or threaded to the faucet and the aerator 211 screwed or attached to the block. In another embodiment, the block 212 and/or aerator 211 may be affixed to the faucet by a twist and lock mechanism that may be employed sometimes for commercial applications. Light source 215 may be a ring-shaped substrate holding at least one LED as described above, with an electrical lead 225 providing power to the light source 215. The light-emitting block 212 provides illumination to a sink or other basin that the block faces, accentuating the basin, which can appear to glow. Although a unitary faucet is shown, a separate spout can also hold a light source near the aerator. Note also that this embodiment may contact water, but the light-emitting block 212 can be easily removed for cleaning.

Figure 12:
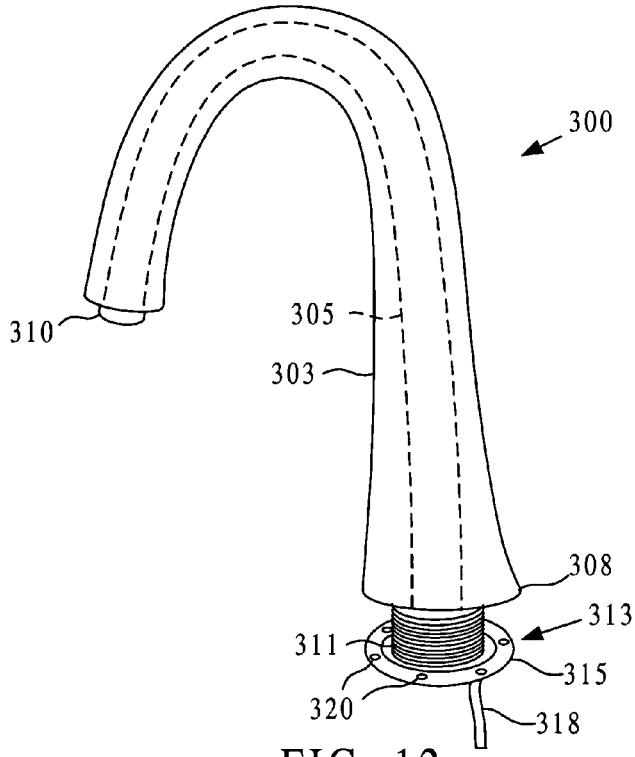
FIG. 12 is a perspective view of a translucent faucet spout with a lamp disposed near the base to illuminate the spout.

FIG. 12 shows a faucet spout 300 including a body 303 that is made entirely of translucent material, such as acrylic, plastic, glass, crystal, etc., which may be clear, frosted or colored. The body 303 encircles a water conduit 305 that provides fluid communication between a base 308 of the spout and an aerator 310. The base 308 is attached to a threaded portion 311 that fits through a hole in a sink top or countertop, not shown in this figure. A light source 313 fits around the threaded portion 311 and beneath the base 308 to illuminate the spout 300. The light source includes a substrate 315 that holds a number of LEDs 320, each of which is connected to an electrical lead 318.

The body 303 has an index of refraction that is greater than that of the air, and so some of the light from the light source 313 flows through the gently curving body to exit near the aerator 310. Stated differently, the body 303 forms a conduit for both water and light. When water flows through the water conduit 305 light may also flow through the water to exit at the aerator 310, which may also be translucent, as an illuminated stream of water. An outer surface of the body may be frosted or may include patterns that reflect or transmit the light. For example, the outer surface may include a plurality of ridges that spiral in helical fashion between the base and the aerator, the ridges transmitting relatively more light so that the helical pattern is accentuated. Alternatively, the outer surface can be encased in metal, plastic or any other hygienically approved material so that the light exits the spout in a ring around the aerator, and also from the aerator for the situation in which the aerator is translucent.

The plumbing light fixtures discussed above can be controlled in various ways. LEDs use little power and can be left on all the time, with the light sources providing beauty and interest to a sink, shower or bathtub area at all times, and also providing a night light for the bathroom for safety and convenience. Alternatively, a faucet lamp can be connected to a switch that is controlled by a light sensor, so that the lamp turns on automatically at night when other bathroom lights are off. As another example, a manually operated switch can be provided, and the switch can be located near other light switches for the room containing the faucet. The plumbing light fixtures can be provided with new construction or remodeling, and can also retrofit existing basins, fixtures and/or faucetry.

The LEDs can emit specific colors or essentially white light. For example, lights for faucet handles can be red for the hot water handle and blue for the cold water handle. Alternatively, the lights can be selected to match or contrast other colors in a room. Translucent blocks through which the light passes are helpful in dispersing light from an individual LED to avoid glare. Such blocks can be transparent or frosted, and can be colored separately from the light sources. Refractive and diffractive effects can also be employed to split multicolored or white light into various colors. The LEDs can be waterproof, and are also disposed within a sealed compartment such as a faucet base or spout.

Figure 13:
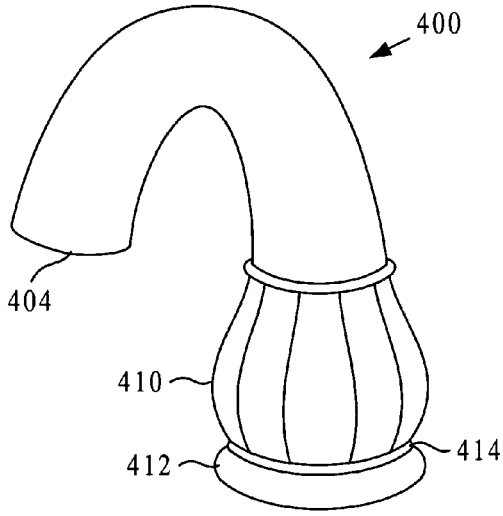
FIG. 13 is a perspective view of a faucet spout with a translucent shroud disposed near the base to provide illumination.

FIG. 13 shows a faucet spout 400 with a translucent shroud 410 disposed near a base 412 of the spout for illumination. The shroud 410, which may sometimes be called a bell or escutcheon, may be made of crystal, glass, acrylic or other materials. The shroud 410 is located in the base region of the spout because it is closer to the base 412 than to a tip 404 of the spout. A light source such as a plurality of LEDs disposed on a ring 414 shines light on an inner surface of the shroud 410, which transmits the light through its outer surface. Such a light emitting shroud may also or alternatively be located on faucet handle, not shown.

Figure 14:
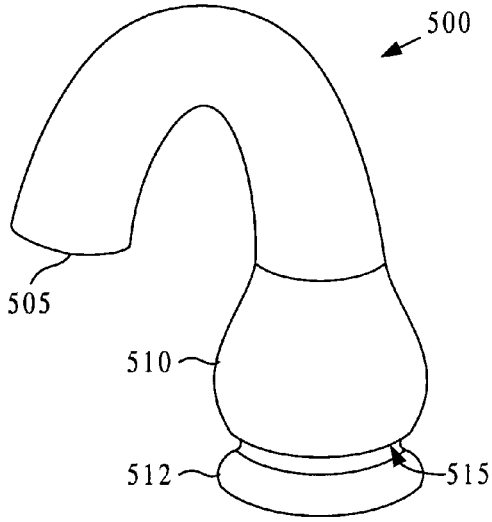
FIG. 14 is a perspective view of a faucet spout with a shroud disposed near the base to illuminate the base.

FIG. 14 shows a faucet spout 500 with an opaque shroud 510 disposed near a base 512 of the spout. The shroud 510 has a skirt 515 that transmits light downward onto the base 515 to illuminate the base.

Although the present disclosure has focused on teaching the preferred embodiments, other embodiments and modifications of this invention may be apparent to persons of ordinary skill in the art in view of these teachings. For example, although LEDs are used in a preferred embodiment other light sources can alternatively be employed, such as fluorescent, incandescent, fiber optic, etc. Also, instead of or in addition to plumbing fixtures, light sources such as those discussed above can be included in trim for related accessories such as towel bars, towel rings, robe hooks, tissue holders, soap holders, etc. Therefore, this invention is to be limited only by the following claims, which include all such embodiments and modifications when viewed in conjunction with the above specification and accompanying drawings.

What is claimed is:

1. A plumbing fixture for supplying water to a basin, the fixture comprising:

a spout containing a water conduit; and a handle connected to a valve to control water flow through the water conduit;

wherein at least one of the handle and the spout has a base region that holds the fixture adjacent to the basin, the base region containing a lamp that emits visible light, the lamp including;

a substrate holding a light source; and a translucent ring that encircles the substrate and light source.

2. The fixture of claim 1, wherein the translucent ring is clamped in the base region.

3. The fixture of claim 1, wherein the spout is made of a translucent body that the light passes through.

4. The fixture of claim 1, wherein the lamp includes a light-emitting diode that is not encapsulated in a light-transmissive encapsulant.

5. The fixture of claim 1, wherein the substrate supports a plurality of light sources and the substrate encircles the water conduit.

6. The fixture of claim 1, wherein the substrate supports a plurality of light sources and the substrate encircles an inlet conduit and an outlet conduit.

7. The fixture of claim 1, wherein the basin is a sink.

8. The fixture of claim 1, wherein the basin is a bathtub.

9. The fixture of claim 1, wherein the spout is made of translucent material that has an outer surface that transmits the light.

10. The fixture of claim 1, wherein the spout has a second translucent ring that encircles an aerator that is disposed distal to the base region.

11. A plumbing fixture for supplying water to a basin, the fixture comprising:

a handle connected to a valve to control water flow from a first water conduit to a second water conduit; and a spout containing at least a portion of the second water conduit, the spout having a base region affixing the spout adjacent to the basin, an aerator in fluid communication wit the second water conduit distal to the base, and a translucent ring that encircles the aerator or the spout and emits light to illuminate the basin.

12. The fixture of claim 11, wherein the ring fits into a seat in the spout that also holds a plurality of light-emitting diodes.

13. The fixture of claim 11, wherein the base region contains the translucent ring and a plurality of light-emitting diodes.

14. The fixture of claim 13, wherein the light-emitting diodes are encircled by the ring.

15. The fixture of claim 13, wherein the spout has a translucent body that encircles the second water conduit and is illuminated with a light source contained in the base region.

16. The fixture of claim 15, wherein the translucent body has a surface with a plurality of ridges.

17. The fixture of claim 11, wherein the handle has a base portion that holds the handle adjacent to the basin, and a second translucent ring is clamped within the base portion.

18. A plumbing fixture for supplying water to a basin having a countertop that the fixture is attached to, the fixture comprising:

a spout containing a water conduit; and a handle connected to a valve to control water flow through the water conduit, the handle having a base region that holds the fixture to the countertop, the base region containing a light source that emits visible light, wherein the light source includes a diode that emits the light and a translucent ring that the light passes through.

19. The fixture of claim 18, wherein the translucent ring encircles the diode.

20. The fixture of claim 18, wherein the translucent ring is clamped to the countertop.

21. The fixture of claim 18, wherein the diode is attached to a substrate that encircles an inlet conduit and an outlet conduit.

22. The fixture of claim 18, wherein the basin is a sink.

23. The fixture of claim 18, wherein the basin is a bathtub.

24. The fixture of claim 18, wherein the spout has a base portion that contains a lamp that emits light through a second translucent ring.

25. A faucet for a basin, the faucet comprising:

a translucent spout containing a water conduit; and a handle connected to a valve to control water flow through the water conduit;

wherein the spout has a base region that is fastened to the basin, the base region containing a lamp, the lamp emitting visible light.

26. The faucet of claim 25, wherein the lamp includes a translucent ring that the light passes through.

27. The faucet of claim 25, wherein the spout has an outer surface that is patterned.

28. The faucet of claim 25, wherein the lamp includes a light-emitting diode.

29. The faucet of claim 25, wherein the base region contains a substrate supporting a plurality of light sources and the substrate encircles the water conduit.

30. The faucet of claim 25, wherein the handle has a base portion containing a substrate supporting a plurality of light sources and the substrate encircles an inlet conduit and an outlet conduit.

31. The faucet of claim 25, wherein a countertop is affixed between the base region and the basin.

32. The faucet of claim 25, wherein the spout is encased in metal.

33. The faucet of claim 25, wherein the spout has a translucent ring that encircles an aerator.

* * * * *